US006319646B1

(12) United States Patent
Suganuma

(10) Patent No.: US 6,319,646 B1
(45) Date of Patent: Nov. 20, 2001

(54) CARRIER FOR ELECTROPHOTOGRAPHIC DEVELOPER, METHOD FOR MANUFACTURING, DEVELOPER, CONTAINER INCLUDING THE DEVELOPER, AND IMAGE FORMING APPARATUS USING THE DEVELOPER WHEREIN THE CARRIER SATISFIES THE RELATIONSHIP 1.0≦C2/C1≦1.3

(75) Inventor: Tohru Suganuma, Numazu (JP)

(73) Assignee: Ricoh Technology Research, Inc., Yokohama (JP)

( * ) Notice: Subject to any disclaimer, the term of this patent is extended or adjusted under 35 U.S.C. 154(b) by 0 days.

(21) Appl. No.: 09/663,716

(22) Filed: Sep. 18, 2000

(30) Foreign Application Priority Data

Sep. 16, 1999 (JP) ..... 11-262036

(51) Int. Cl.[7] ..... G03G 9/00

(52) U.S. Cl. ..... 430/111.4; 430/111.35; 430/137.13

(58) Field of Search ..... 430/106, 108, 430/110, 111.4, 111.35, 137.13

(56) References Cited

U.S. PATENT DOCUMENTS 5,652,079 * 7/1997 Mochizuki et al. ..... 430/108
5,683,844 * 11/1997 Mammino ..... 430/108
5,952,143 * 9/1999 Ootaki et al. ..... 430/108

FOREIGN PATENT DOCUMENTS 01300097 11/1989 (JP) .
02207565 8/1990 (JP) .

* cited by examiner

*Primary Examiner*—John Goodrow
(74) *Attorney, Agent, or Firm*—Oblon, Spivak, McClelland, Maier & Neustadt, P.C.

(57) ABSTRACT

A carrier for electrophotographic developer, including a magnetic core material whose surface is coated with a resin, wherein the carrier satisfies the following relationship:

$1.0 \leqq C2/C1 \leqq 1.3$ wherein C1 represents a charge quantity of a developer (1) including the carrier and a first toner after the developer (1) is subjected to a frictional charge treatment once, wherein concentration of the first toner in the developer (1) is 3% by weight; and C2 represents a charge quantity of a developer (2) including the carrier, which has been separated from the developer (1) subjected to the frictional charge treatment, and a second toner when the charge quantity is measured after the developer (2) is subjected to the frictional charge treatment once, wherein concentration of the second toner in the developer (2) is 3% by weight, wherein the first and second toner are the same or different.

26 Claims, 1 Drawing Sheet

CARRIER FOR ELECTROPHOTOGRAPHIC DEVELOPER, METHOD FOR MANUFACTURING, DEVELOPER, CONTAINER INCLUDING THE DEVELOPER, AND IMAGE FORMING APPARATUS USING THE DEVELOPER WHEREIN THE CARRIER SATISFIES THE RELATIONSHIP 1.0≦C2/C1≦1.3

BACKGROUND OF THE INVENTION

1. Field of the Invention

The present invention relates to a carrier for use in a developer for developing an electrostatic latent image formed by an electrophotographic method, an electrostatic printing method, an electrostatic recording method or the like method. In addition, the present invention relates to a method for manufacturing the carrier.

2. Discussion of the Background

Two component developers which are constituted of a carrier and a toner are widely used for developing an electrostatic latent image formed on an image bearing member by an electrophotographic method, an electrostatic printing method, an electrostatic recording method or the like method. In particular, in recent years resin-coated carriers in which a core material is coated with a resin are typically used to enhance the durability of the carrier. Such resin-coated carriers have a good electric insulation property, and therefore, the resin-coated carriers have a good charge imparting property. In addition, the surface of the resin-coated carriers have good smoothness, and therefore the carriers have good durability.

However, the resin-coated carriers have a drawback in that the carriers produce images having a poor solid image in which only the edge portions of the solid image are emphasized and the other portions thereof has poor image density (hereinafter this phenomenon is referred to as an edge-emphasized image). In attempting to remedy this drawback, a half-coated carrier in which a part of the surface of carrier particles is coated with a resin (i.e., projected portions of the core material are exposed without being coated) has been proposed in Japanese Laid-Open Patent Publications Nos. 3-160463 and 4-93954. Since in the half-coated carrier project portions of the core material are exposed without being coated, the half-coated carrier has relatively low electric resistance. Therefore, the charges tend to be easily transferred, resulting in formation of a solid image having high image density (without causing an edge-emphasized image). However, since the half-coated carrier has relatively low electric resistance, a charge whose polarity is opposite to that formed on an image bearing member is injected to the carrier, resulting in occurrence of a carrier adhesion problem in that the carrier itself adheres to the image bearing member.

In addition, in recent years a toner recycle system is used in image forming apparatus in which toner particles, which are collected in the image forming apparatus without being used for developing electrostatic latent images, are reused to protect environment. Namely, the toner recycle system is such that toner particles remaining on an image bearing member without being transferred to a receiving paper are collected by a cleaning device, and the collected toner particles are supplied again to the developing area or the toner supplying device to be reused. In the collected toner particles, external additives of the toner particles tend to be embedded into the toner particles, and therefore the surface of the carrier is hardly abraded by the toner. Therefore the surface of the carrier is hardly refreshed, i.e., the toner tends to accumulate on the surface of the carrier, resulting in occurrence of a spent-toner problem. When the spent-toner problem occurs, the charge quantity of the developer deteriorates, resulting in occurrence of background fouling in the resultant toner images. Therefore, the developer has a short life. In particular, the half-coated carrier has projected portions which are not coated with a resin, and therefore this spent-toner problem easily occurs.

Because of these reasons, a need exists for a developer having good durability and capable of producing images having good image qualities even when used for an image forming apparatus using a toner recycle system for a long time.

SUMMARY OF THE INVENTION

Accordingly, an object of the present invention is to provide a carrier useful for a developer having the following advantages:

(1) having good durability without causing the spent-toner problem;

(2) not causing the carrier adhesion problem; and (3) capable of producing images having good image qualities such as high image density even when used for an image forming apparatus using a toner recycle system.

Briefly this object and other objects of the present invention as hereinafter will become more readily apparent can be attained by a carrier which includes a magnetic core material having a surface coated with a resin, wherein the carrier satisfies the following relationship:

$1.0 \leqq C2/C1 \leqq 1.3$ wherein C1 represents a charge quantity of a developer (1) including the carrier and a first toner after the developer (1) is subjected to a frictional treatment once, wherein concentration of the first toner in the developer (1) is 3% by weight; and C2 represents a charge quantity of a developer (2) which includes the carrier separated from the developer (1) subjected to the frictional charge treatment and a second toner when the charge quantity is measured after the developer (2) is subjected to the frictional charge treatment once, wherein concentration of the second toner in the developer (2) is 3% by weight, wherein the first toner and the second toner can be the same or different.

Preferably, the carrier satisfies the following relationships:

$1.0 \leqq C2/C1 \leqq 1.3$, and $1.0 \leqq C3/C2 \leqq 1.3$ wherein C1 and C2 are defined above, and C3 represents a charge quantity of a developer (3) which includes the carrier separated from the developer (2) and a third toner when the charge quantity is measured after the developer (3) is subjected to the frictional charge treatment once, wherein concentration of the third toner in the developer (3) is 3% by weight, wherein the third toner is the same as or different from either or both of the first and second toners.

The surface of the carrier particles preferably has one or more micro projections having an irregular circular shape whose average minor diameter is from about 100 nm to about 200 nm when observed by an AFM (Atomic Force Microscope) method.

The resin coated on the surface of the carrier preferably includes a silicone resin.

In addition, the carrier preferably has a dynamic current of from 0.1 $\mu$A to 0.5 $\mu$A.

In another aspect of the present invention, a method for manufacturing the above-mentioned carrier including the steps of coating a core material with a resin solution including a resin at a concentration not less than 10% by weight, and crosslinking the resin while fluidizing the carrier.

These and other objects, features and advantages of the present invention will become apparent upon consideration of the following description of the preferred embodiments of the present invention in conjunction with the accompanying drawing.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein.

DETAILED DESCRIPTION OF THE INVENTION

Figure 1:
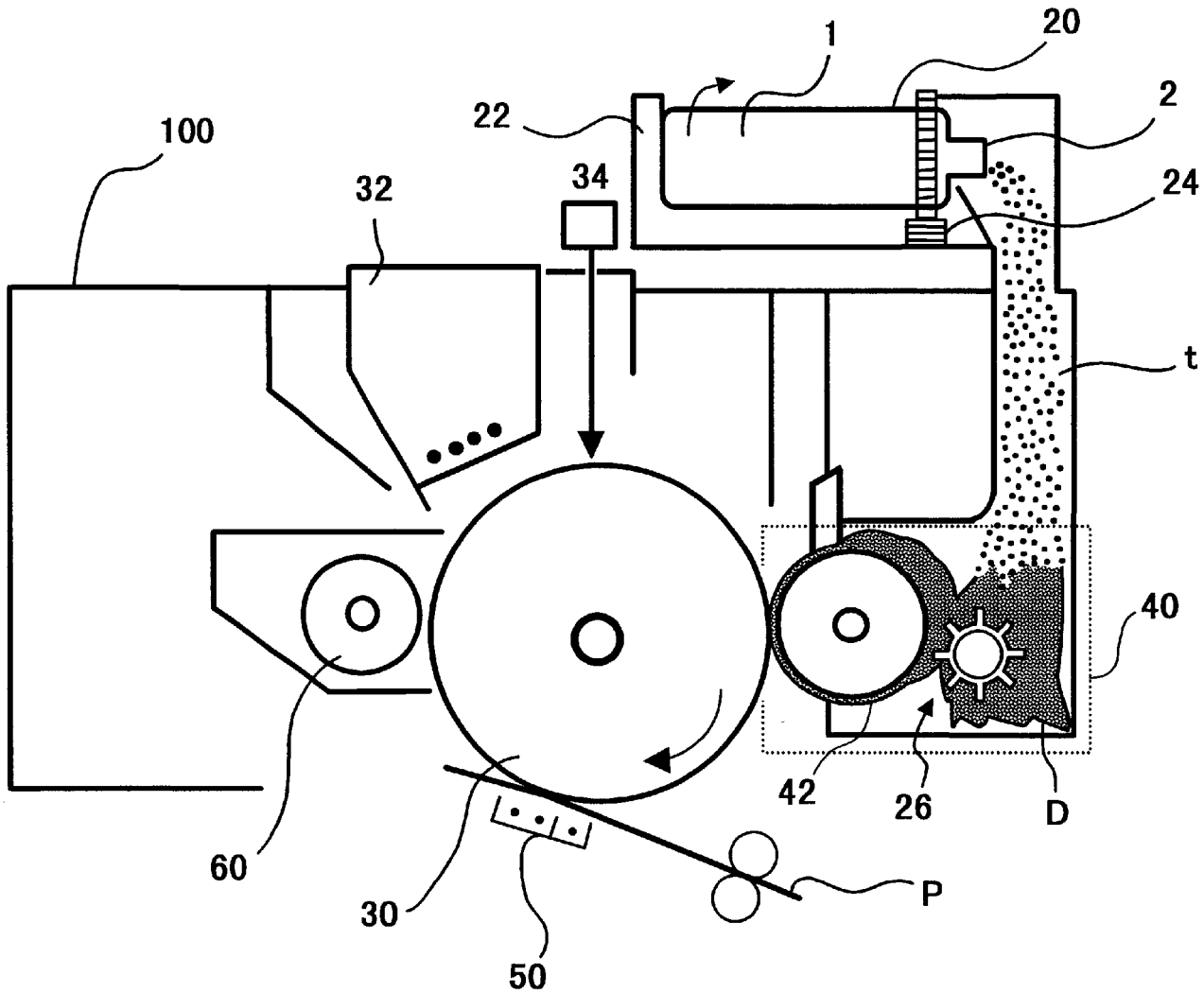
FIG. 1 is a schematic view illustrating a main part of an embodiment of the image forming apparatus of the present invention.

Generally, the present invention provides a carrier which includes a magnetic core material having a surface coated with a resin, wherein the carrier satisfies the following relationship:

$1.0 \leqq C2/C1 \leqq 1.3$ wherein C1 represents a charge quantity of a developer (1) including the carrier and a first toner after the developer (1) is subjected to a frictional charge treatment once, wherein concentration of the first toner in the developer (1) is 3% by weight; and C2 represents a charge quantity of a developer (2) which includes the carrier separated from the developer (1) subjected to the frictional charge treatment and a second toner when the charge quantity is measured after the developer (2) is subjected to the frictional charge treatment once, wherein concentration of the second toner in the developer (2) is 3% by weight, wherein the first toner and the second toner are the same or different.

In the present invention, the following relationships are preferably satisfied:

$1.0 \leqq C2/C1 \leqq 1.3$ and $1.0 \leqq C3/C2 \leqq 1.3$ wherein C1 and C2 are defined above; and C3 represents a charge quantity of a developer (3) which includes the carrier separated from the developer (2) subjected to the frictional charge treatment and a third the toner when the charge quantity is measured after the developer (3) is subjected to the frictional charge treatment once, wherein concentration of the third toner in the developer (3) is 3% by weight, wherein the third toner is the same as or different from either or both of the first and second toners.

When a developer including a carrier and a toner is evaluated whether the developer satisfies the relationships, C1 represents a charge quantity of the developer. Namely, the charge quantity of the developer is measured while the first frictional charge treatment is not performed. This is because developers are typically agitated preliminarily. In addition, when a developer is evaluated whether the developer satisfies the relationships, it is preferable to use a supplemental toner having substantially the same composition as or a composition similar to the toner, which is preliminarily mixed with the carrier in the developer, as the second toner when C2 and C3 are determined.

In the present invention, the charge quantity of a carrier and a toner which do not constitute a developer (i.e., which are not yet mixed) is measured as follows:

(1) a carrier and a toner are mixed in a cylindrical container having a capacity of 100 ml, and inside diameter of from 45 to 50 mm, and a height of from 80 to 90 mm to prepare 20 grams of a developer (1) whose toner concentration is 3% by weight;

(2) the developer (1) is settled for 24 hours or more under conditions of from 20 to 25° C. in temperature and from 50 to 60% in relative humidity while the cap of the container is opened;

(3) the container including the developer (1) is capped and shaken 15 times with hands and then shaken for 2 minutes using a shaker in a shaking direction of 30° and at a shaking speed of 150 times per minute;

(4) the developer (1) is set on a metal sieve which is made of SUS316 and which is set on a container of a charge measuring instrument having a Faraday cage, a blow/suction device, and a charge measuring device;

(5) the developer (1) is subjected to a blow-off treatment* to remove the toner from the surface of the carrier while measuring the charge quantity (in this case, a suitable sieve is selected so that the carrier particles do not pass the opening of the sieve and the toner particles pass through the opening);

(6) when the charge quantity is saturated, the blow-off treatment is finished;

(7) the charge quantity obtained is divided by a weight of the blown-off toner to obtain a charge quantity per unit weight of the developer (1) (i.e., the charge quantity C1 of the developer (1));

(8) the carrier remaining on the sieve and a fresh quantity of the toner are mixed in a cylindrical container having a capacity of 100 ml, an inside diameter of from 45 to 50 mm, and a height of from 80 to 90 mm to prepare 20 grams of a developer (2) whose toner concentration is 3% by weight;

(9) the procedures of from (3) to (7) are repeated to determine the charge quantity C2 of the developer (2); and

(10) the procedures of (8) and (9) are repeated to determine the charge quantity C3 of a developer (3).

*Blow-off treatment: The treatment is to blow a compressed air to a developer including a toner and a carrier and set on a sieve to separate the toner from the surface of the carrier. The toner passing through the sieve is sucked by an air sucker. The pressures of the compressed air and the suction pressure are determined such that ninety percent by weight or more of the toner in the developer can be removed therefrom.

When the charge quantity of a developer in which a carrier and a toner is mixed and agitated is determined, the procedures are as follows:

(1') 20 grams of a developer are settled for 24 hours or more under conditions mentioned in paragraph (2), wherein the toner concentration of the developer is controlled so as to be 3% by weight; and (2') the procedures of from (4) to (10) are repeated using the developer prepared in paragraph (1').

In the present invention, the following relationship is satisfied:

$1.0 \leqq C2/C1 \leqq 1.3$

Preferably, the following relationships are satisfied.

$1.0 \leqq C2/C1 \leqq 1.3$ and $1.0 \leqq C3/C2 \leqq 1.3$.

When the ratio is in the range, the charge quantity of the developer does not deteriorate, and therefore good images without background fouling can be produced even when the developer is used for a long time.

When the ratio is greater than 1.3, the charge quantity of the developer seriously increases during image forming operations, resulting in deterioration of image density of the resultant developed image. On the contrary, when the ratio is less than 1.0, the charge quantity of the developer seriously decreases during image forming operations, resulting in formation of background fouling in the resultant developed image. Namely, in both cases, the developer has poor durability.

The surface of the carrier of the present invention preferably has one or more micro projections having an irregular circular shape when the surface is observed by an AFM (Atomic Force Microscope) method. The average minor diameter of the micro projections (i.e., the average shorter diameter of the circular shape of the micro projections) is preferably from about 100 nm to about 200 nm to produce good images without background fouling. It is hard to observe such projections by a general method using an electron microscope.

The AFM method will be explained in detail.

The AFM method is one of SPM methods which use a scanning probe microscope and which are used for observing and analyzing surface of polymers, semiconductors, inorganic materials, biochemical products and the like materials. The scanning probe microscope scans with a probe a surface of a material in a region on the order of few nanometers to few micrometers. Thus, the three-dimensional information of the surface and physical information between the surface and the probe. The SPM methods are broadly classified into STM (scanning tunneling microscope) methods and AFM (atomic force microscope) methods. In AFM methods, a probe connected with a cantilever scans a surface of a material. A laser beam irradiates the cantilever. The reflected laser beam is detected with a photo-detector to detect the displacement of the cantilever.

A single crystal of silicon, or $Si_3N_4$ are typically used as the cantilever. In addition, the probe is also made of the same material. The shape or spring constant of the probe is changed depending on the material to be analyzed and the purposes of the analysis.

The advantages of the AFM method are as follows:

(1) a sample to be analyzed is easily prepared;

(2) measurements can be performed under various conditions (for example, in air, a gas, a liquid, vacuum or the like);

(3) having a resolution on the order of few angstroms; and (4) capable of obtaining not only three dimensional information but also information such as frictional properties, viscoelastic properties, information concerning magnetic field and charge.

The AFM methods are classified into contact-mode AFM methods in which a probe scans a surface while the probe is contacting the surface, alternating-mode AFM methods (i.e., tapping-mode AFM methods named by Digital Instruments) in which a probe intermittently contacts a surface to be analyzed, and noncontact-mode AFM methods a probe scans a surface while the probe does not contact the surface. Among these AFM methods, the tapping-mode AFM methods are versatile.

In the present invention, the surface of carrier particles is observed with a system which is manufactured by DIGITAL INSTRUMENTS and which includes a controller, Nanoscope IIIa, and a scanning probe microscope, D3100/D, using a tapping-mode AFM method. The carrier particles to be observed are fixed on a disc using an adhesive tape. The disc is fixed in the scanning electron microscope with a magnet catch. The amplitude image of the surface in a 3-$\mu$m square is observed. The measuring conditions are as follows:

(1) probe: cantilever type crystal silicon needle (2) resonance frequency of the probe: about 330 kHz (3) spring constant of the probe: about 40 N/m When a carrier having one or more micro projections having an average minor diameter of from about 100 nm to 200 nm on at least a portion of the surface thereof is mixed with a toner, the carrier and the toner (i.e., the developer) are rapidly frictionally-charged, and thereby the developer can produce good image without background fouling. On the contrary, when a carrier having no micro projection having a minor diameter of from about 100 nm to 200 nm on the surface thereof is used, the developer produces images with background fouling because the developer is not rapidly frictionally-charged and therefore toner particles having a relatively low charge quantity are present in the developer.

The core material of the carrier of the present invention is not particularly limited, and known core materials can be used as the core material. Specific examples of the known core materials include metals such as ferrite, magnetite, iron, nickel and cobalt; metal alloys or mixtures of the metals mentioned above with zinc, antimony, aluminum, lead, tin, bismuth, beryllium, manganese, selenium, tungsten, zirconium, and vanadium; mixtures of the metals mentioned above with metal oxides such as iron oxides, titanium oxides and magnesium oxides; mixtures of the metals mentioned above with metal carbides such as silicon carbides, and tungsten carbides; and ferromagnetic ferrites. These materials can be used alone or in combination.

The resin which is used for coating the core material is not particularly limited, and known resins can be used as the resin. Specific examples of the resin include polystyrene resins, acrylic resins, styrene-acrylic resins, vinyl resins, ethylene resins, polyester resins, silicone resins, fluorine-containing resins and the like resins. These resins are used alone or in combination.

Among these resins, silicone resins are preferable because of having low surface energy. Suitable silicone resins include silicone resins which can perform a condensation reaction and which have a methyl group as a substituent. When such a silicone resin is used for coating a core material, the resultant coated carrier has good water-repellent property because the resin forms a layer having a dense structure. Therefore a carrier which hardly causes the spent-toner problem can be obtained.

In the present invention, various additives may be added to the resin. For example, resistance controlling materials such as carbon black, which control the resistance of the coated carrier, and adhesion enhancing materials such as silane coupling agents which improve the adhesion of the resin layer to the core material, can be used as the additives.

The resistance of the carrier of the present invention is preferably from 0.1 $\mu$A to 0.5 $\mu$A when the resistance of the carrier is represented as a dynamic current. When the dynamic current is greater than 0.5 $\mu$A, the resultant images tend to have undesired images such as tailing and/or broadened line images (i.e., deterioration of resolution). On the contrary, the dynamic current is less than 0.1 $\mu$A, the carrier-adhesion problem tends to occur and therefore the image density deteriorates.

The dynamic current can be measured by the following method:

(1) 200 grams of a carrier is held on an electroconductive magnetic sleeve; and (2) the sleeve is rotated at a rotation speed of 200 rpm while a voltage of 200 V is applied to a blade, which contacts the carrier and whose tip edge is apart from the surface of the sleeve by 1.0 mm, to measure a current (i.e., the dynamic current) flowing between the blade and the sleeve.

Then the manufacturing method of the carrier will be explained.

The carrier of the present invention is manufactured by the following method:

(1) preparing a solution in which a resin to be coated is dissolved in a proper solvent;

(2) coating a core material with the above-prepared solution by a dip coating method, a spray coating or the like method to coat the resin on the entire surface of the carrier; and (3) subjecting the coated carrier to a heat treatment to crosslink the resin while the carrier is fluidized.

The ratio of the resin coated on the carrier to the coated carrier is preferably from about 1.0/100 to about 2.1/100 by weight.

As the method for heat-crosslinking the resin coated on the carrier while fluidizing the carrier, for example, a method using a tunnel kiln can be used. However, the heat-crosslinking method is not limited to the method using a tunnel kiln. When the heat-crosslinking treatment is performed while the carrier is settled (i.e., while the carrier is not fluidized), the resin layer is formed along the uneven (i.e., up-and-down) surface of the carrier. Therefore, the resultant resin-coated carrier has also rough surface (up-and-down surface). When such a resin-coated carrier having rough surface is mixed with a toner and repeatedly agitated to frictionally charge the carrier and the toner, the charge quantity of the carrier and the toner decreases and therefore the carrier has poor durability.

However, when the heat crosslinking treatment is performed while the carrier is fluidized, the resultant resin-coated carrier has smooth surface. Therefore, the charge quantity of the carrier (developer) is stable even when repeatedly agitated with a toner to frictionally charge the carrier and the toner. Therefore, the carrier has good durability.

The rotation speed of the tunnel kiln is important for the smoothness of the resultant resin-coated carrier surface. Specifically, the rotation speed is preferably in a range of from 0.5 to 1.5 rpm (revolution per minute). When the rotation speed is less than 0.5 rpm, a carrier having good surface cannot be obtained because the carrier is not sufficiently rotated. When the rotation speed is greater than 1.5 rpm, a carrier having good surface cannot also be obtained because the coated resin peels from the carrier.

In addition, by blowing air into the tunnel kiln, a carrier which has a smooth surface and one or more micro projections having an average minor diameter (i.e., an average shortest diameter of an irregular circle) of from about 100 nm to about 200 nm on the surface thereof can be obtained. As mentioned above, the micro projections can be observed by the AFM method.

When a carrier and a toner are agitated to be frictionally charged, particles of the carrier are frictionally charged in general, resulting in prevention of charging of the toner. However, when a carrier having such micro projections on the surface thereof is agitated with a toner, the projections selectively charge the toner, and therefore the toner has good charge rising property. Therefore, good images without background fouling can be produced.

The resin concentration of the resin solution to be coated on the surface of the carrier is preferably from 10 to 50% by weight, and more preferably from 12 to 40% by weight. When the resin concentration of the resin solution is less than 10% by weight, the resin coated on the carrier tends to be peeled from the carrier when the carrier is fluidized because the viscosity of the solution is too low. When the resin concentration is greater than 50% by weight, the resin-coated carrier particles tend to aggregate, resulting in decrease of yield of the carrier when the carrier is manufactured.

Next, the toner for use in the present invention will be explained. The toner for use in the present invention includes at least a resin, a colorant and a release agent. Suitable resins include known resins which are conventionally used for electrophotographic toners. Specific examples of the resins include styrene resins, acrylic resins, styrene-acrylic copolymer resins, polyester resins, epoxy resins, styrene-butadiene resins, and the like resins. The toner is manufactured by, for example, the following method:

(1) toner constituents are mixed using a Henshel mixer;

(2) the mixture is kneaded while being heated using a kneader such as one-axis kneaders, two-axis kneaders, or two roll mills and the like kneaders;

(3) the kneaded mixture is cooled;

(4) the cooled mixture is pulverized using, for example, a jet air pulverizer or a mechanical pulverizer, and then classified using an air classifier or the like to prepare a mother toner; and (5) the mother toner is mixed with an external additive, if desired, to prepare a toner.

Then the image forming apparatus of the present invention will be explained.

FIG. 1 is a schematic view illustrating a main part of an embodiment of the image forming apparatus 100 useful for the image forming method of the present invention.

As shown in FIG. 1, a toner container 1 including a toner is horizontally and detachably set in a toner supplying device 20 of an image forming apparatus 100 to supply a toner to a developing device 40. A developer D is preliminarily set in the developing device 40 using a container having an opening. The toner supplying device 20 includes a toner container supporting member 22 which supports a toner container 1 such that the opening 2 of the toner container 1 leads to a developer supplying portion 26 in the developing device 40. In addition, the toner supplying device 20 includes a toner container rotating member 24 which rotates the toner container 1 such that the container 1 rotates around the center axis thereof. The toner t is discharged from the opening 2 toward the developer supplying portion 26.

As shown in FIG. 1, a layer of the developer D is formed on a developing roller 42. On the other hand, a photoreceptor 30 (i.e., an image bearing member) is charged with a charger 32. Then an imagewise light irradiating device 34 irradiates the charged photoreceptor with light to form an electrostatic latent image on the photoreceptor 30. The latent image is developed with the developer layer to form a toner image on the photoreceptor 30. The toner image is transferred to a receiving paper P using a transfer device 50. Then the photoreceptor 30 is cleaned with a cleaner 60. The toner image on the receiving paper P is fixed by a fixing device (not shown). Thus, a document is produced.

Since only the toner adheres to the photoreceptor 30 to form a toner image, the concentration of the toner in the developer gradually decreases. Therefore, a supplemental toner included in a container such as the toner container 1 is set on the toner supplying device 20 to supply the toner to the developer supplying portion 26 in the developing device 40.

The developer and the supplemental toner which are contained in respective containers are generally sold alone. The developer and the supplemental toner are generally set in image forming apparatus by their users.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Carrier

Seventy five (75) parts of a Cu—Zn ferrite tradenamed as F-150 and manufactured by Powder Tech Corp. was coated with a coating liquid including 13.5 parts of a polytetrafluoroethylene resin solution tradenamed as D-1 and manufactured by Daikin Industries, Ltd.; 0.02 parts of carbon black tradenamed as Black Pearls 2000 and manufactured by Cabot Corp.; 0.074 parts of another carbon black tradenamed as Kechen Black EC.DJ600 and manufactured by Lion Akzo Co., Ltd.; and 0.015 parts of a chlorosilane coupling agent tradenamed as SH6076 and manufactured by Dow Corning Toray Silicone Co., Ltd. The coating was performed by a spray coating method. The resin concentration of the resin solution D-1 was 15% by weight. Then the resin coated carrier was subjected to a crosslinking treatment using a tunnel kiln which rotated at a rotation speed of 0.5 rpm. The feeding speed of the carrier in the kiln was 120 kg/hour, and the temperature of the crosslinking treatment was 310° C. In this case, the crosslinking treatment was performed while not blowing air to the kiln. Then the coated carrier was sieved to remove aggregates. Thus, a resin-coated carrier was prepared.

The friction charge ratios of the carrier, C2/C1 and C3/C2, were 1.2 and 1.1, respectively. In addition, the dynamic current of the carrier was 0.7 $\mu$A. Further, micro projections could not observed on the surface of the coated carrier.

Preparation of toner

Seventy (70) parts of a polyester resin (tradenamed as Lunapail 1447 and manufactured by Arakawa Chemical Industries, Ltd.), 30 parts of a styrene-acrylic copolymer resin (tradenamed as Himer 75 and manufactured by Sanyo Chemical Industries Ltd.), 1 part of a polarity controlling agent (tradenamed as Bontron P51 and manufactured by Orient Chemical Industries Co., Ltd., a quaternary ammonium salt), 5 parts of a wax serving as a release agent (tradenamed as 102 and manufactured by Ceralica Noda), and 15 parts of a carbon black serving as a colorant (tradenamed as #44 and manufactured by Mitsubishi Chemical Corp.) were mixed by a Henshel mixer. The mixture was kneaded by a two roll mill, and then pulverized by a jet air pulverizer. The pulverized mixture was classified by an air classifier. Thus, a mother toner having a volume average particle diameter of 9 $\mu$m was prepared. One half part of a hydrophobic silica was added to 100 parts of the mother toner to prepare a toner.

Preparation of Developer

The carrier and the toner prepared above were mixed to prepare a two component developer having a toner concentration of 3% by weight.

Example 2

Preparation of Carrier

Seventy five (75) parts of a Cu—Zn ferrite tradenamed as F-150 and manufactured by Powder Tech Corp. was coated with a coating liquid including 13.5 parts of a polytetrafluoroethylene resin solution tradenamed as D-1 and manufactured by Daikin Industries, Ltd.; 0.02 parts of carbon black tradenamed as Black Pearls 2000 and manufactured by Cabot Corp.; 0.074 parts of another carbon black tradenamed as Kechen Black EC.DJ600 and manufactured by Lion Akzo Co., Ltd.; and 0.015 parts of a chlorosilane coupling agent tradenamed as SH6076 and manufactured by Dow Corning Toray Silicone Co., Ltd. The coating was performed by a spray coating method. The resin concentration of the resin solution D-1 was 15% by weight. Then the resin coated carrier was subjected to a crosslinking treatment using a tunnel kiln which rotated at a rotation speed of 0.5 rpm. The feeding speed of the carrier in the kiln was 120 kg/hour, and the temperature of the crosslinking treatment was 310° C. In this case, the crosslinking treatment was performed while blowing air to the kiln. Then the coated carrier was sieved to remove aggregates. Thus, a resin-coated carrier was prepared.

The friction charge ratios of the carrier, C2/C1 and C3/C2, were 1.3 and 1.1, respectively. In addition, the dynamic current of the carrier was 0.6 $\mu$A. Further, micro projections could be observed on the surface of the coated carrier.

Preparation of Developer

The thus prepared carrier was mixed with the toner prepared in Example 1 to prepare a two component developer having a toner concentration of 3% by weight.

Example 3

Preparation of Carrier

Seventy five (75) parts of a Cu—Zn ferrite tradenamed as F-150 and manufactured by Powder Tech Corp. was coated with a coating liquid including 13.5 parts of a silicone resin solution tradenamed as SR2405 and manufactured by Toray Corning Co., Ltd.; 0.015 parts of carbon black tradenamed as Black Pearls 2000 and manufactured by Cabot Corp.; 0.074 parts of another carbon black tradenamed as Kechen Black EC.DJ600 and manufactured by Lion Akzo Co., Ltd.; and 0.015 parts of a chlorosilane coupling agent tradenamed as SH6076 and manufactured by Dow Corning Toray Silicone Co., Ltd. The coating was performed by a spray coating method. The resin concentration of the resin solution SR2405 was 15% by weight. Then the resin coated carrier was subjected to a crosslinking treatment using a tunnel kiln which rotated at a rotation speed of 0.5 rpm. The feeding speed of the carrier in the kiln was 120 kg/hour, and the temperature of the crosslinking treatment was 330° C. In this case, the crosslinking treatment was performed while blowing air to the kiln. Then the coated carrier was sieved to remove aggregates. Thus, a resin-coated carrier was prepared.

The friction charge ratios of the carrier, C2/C1 and C3/C2, were 1.2 and 1.2, respectively. In addition, the dynamic current of the carrier was 0.6 $\mu$A. Further, micro projections could be observed on the surface of the coated carrier.

Preparation of Developer

The thus prepared carrier was mixed with the toner prepared in Example 1 to prepare a two component developer having a toner concentration of 3% by weight.

Example 4

Preparation of Carrier

Seventy five (75) parts of a Cu—Zn ferrite tradenamed as F-150 and manufactured by Powder Tech Corp. was coated with a coating liquid including 13.5 parts of a polytetrafluoroethylene resin solution tradenamed as D-1 and manufactured by Daikin Industries, Ltd.; 0.01 parts of carbon black tradenamed as Black Pearls 2000 and manufactured by Cabot Corp.; 0.074 parts of another carbon black tradenamed as Kechen Black EC.DJ600 and manufactured by Lion Akzo Co., Ltd.; and 0.015 parts of a chlorosilane coupling agent tradenamed as SH6076 and manufactured by Dow Corning Toray Silicone Co., Ltd. The coating was performed by a spray coating method. The resin concentration of the resin solution D-1 was 15%by weight. Then the resin coated carrier was subjected to a crosslinking treatment using a tunnel kiln which rotated at a rotation speed of 0.5 rpm. The feeding speed of the carrier in the kiln was 120 kg/hour, and the temperature of the crosslinking treatment was 310° C. In this case, the crosslinking treatment was performed while blowing air to the kiln. Then the coated carrier was sieved to remove aggregates. Thus, a resin-coated carrier was prepared.

The friction charge ratios of the carrier, C2/C1 and C3/C2, were 1.2 and 1.1, respectively. In addition, the dynamic current of the carrier was 0.3 $\mu$A. Further, micro projections could be observed on the surface of the coated carrier.

Preparation of Developer

The thus prepared carrier was mixed with the toner prepared in Example 1 to prepare a two component developer having a toner concentration of 3% by weight.

Comparative Example 1

Preparation of Carrier

Seventy five (75) parts of a Cu—Zn ferrite tradenamed as F-150 and manufactured by Powder Tech Corp. was coated with a coating liquid including 13.5 parts of a silicone resin solution tradenamed as SR2405 and manufactured by Toray Corning Co., Ltd.; 0.015 parts of carbon black tradenamed as Black Pearls 2000 and manufactured by Cabot Corp.; 0.074 parts of another carbon black tradenamed as Kechen Black EC.DJ600 and manufactured by Lion Akzo Co., Ltd.; and 0.015 parts of a chlorosilane coupling agent tradenamed as SH6076 and manufactured by Dow Corning Toray Silicone Co., Ltd. The coating was performed by a spray coating method. The resin concentration of the resin solution SR2405 was 15% by weight. Then the resin coated carrier was subjected to a crosslinking treatment using a tunnel kiln which rotated at a rotation speed of 0.5 rpm. The resin concentration of the resin solution SR2405 was 15% by weight. Then the resin coated carrier was subjected to a crosslinking treatment while being settled in a kiln which did not rotated. The temperature of the crosslinking treatment was 300° C. Then the coated carrier was sieved to remove aggregates. Thus, a resin-coated carrier was prepared.

The friction charge ratios of the carrier, C2/C1 and C3/C2, were 0.7 and 0.9, respectively. In addition, the dynamic current of the carrier was 0.3 $\mu$A. Further, micro projections could not be observed on the surface of the coated carrier.

Preparation of Developer

The thus prepared carrier was mixed with the toner prepared in Example 1 to prepare a two component developer having a toner concentration of 3% by weight.

Comparative Example 2

Preparation of Carrier

Seventy five (75) parts of a Cu—Zn ferrite tradenamed as F-150 and manufactured by Powder Tech Corp. was coated with a coating liquid including 13.5 parts of a silicone resin solution tradenamed as SR2405 and manufactured by Toray Corning Co., Ltd.; 0.015 parts of carbon black tradenamed as Black Pearls 2000 and manufactured by Cabot Corp.; 0.074 parts of another carbon black tradenamed as Kechen Black EC.DJ600 and manufactured by Lion Akzo Co., Ltd.; and 0.015 parts of a chlorosilane coupling agent tradenamed as SH6076 and manufactured by Dow Corning Toray Silicone Co., Ltd. The coating was performed by a spray coating method. The resin concentration of the resin solution SR2405 was 15% by weight. Then the resin coated carrier was subjected to a crosslinking treatment using a tunnel kiln which rotated at a rotation speed of 0.5 rpm. The resin concentration of the resin solution SR2405 was 15% by weight. Then the resin coated carrier was subjected to a crosslinking treatment while being settled in a kiln which did not rotated. The temperature of the crosslinking treatment was 330° C. Then the coated carrier was sieved to remove aggregates. Thus, a resin-coated carrier was prepared.

The friction charge ratios of the carrier, C2/C1 and C3/C2, were 1.6 and 1.4, respectively. In addition, the dynamic current of the carrier was 0.2 $\mu$A. Further, micro projections could not be observed on the surface of the coated carrier.

Preparation of Developer

The thus prepared carrier was mixed with the toner prepared in Example 1 to prepare a two component developer having a toner concentration of 3% by weight.

Each of the developers of Examples 1 to 4 and comparative developers of Comparative Examples 1 and 2 was set in a copier, which is a modified copier of RICOPY FT-6500 manufactured by Ricoh Co., Ltd., to perform a copying test. The copier was modified such that a toner recycle system in which toner particles remaining on the photoreceptor was collected with a cleaning device to be reused in the developing device. In the copying test, 300,000 copies were reproduced. The images of the copies were evaluated as follows:

(1) Image Density

The reflection density of a black solid image was measured by a Macbeth densitometer.

(2) Background Fouling

The images were visually observed whether the image had background fouling. The quality of background fouling was classified into the following three ranks:

○: good (the images have no background fouling)

Δ: acceptable (the images have slight background fouling, but the toner can be practically used)

X: poor (the images have serious background fouling so that the toner cannot be practically used)

(3) Spent-toner Problem

A used carrier was weighed with a chemical balance and then contained in a container. A certain amount of toluene was added to the container. The mixture was ultrasonically vibrated for 1 minute to dissolve the spent-toner adhered on the carrier in toluene. The transparency of the liquid in which the spent-toner was dissolved in toluene was measured with a turbidimeter. The transparency is the substitution for the amount of the spent toner. The amount of the spent toner was evaluated by the following classification:

○: transparency of from 90 to 100%

Δ: transparency of from 70 to 90%

X: transparency of less than 70%

(4) Carrier Adhesion Problem

The images were visually observed whether the image has carrier particles. The quality was classified as follows:

○: the images do not have carrier particles

X: the images have carrier particles (5) Resolution

An original image including line images having various intervals were copied. The copied images were visually observed whether the developers could clearly reproduced the line images. The resolution was defined as the maximum line density (lines/mm) of the line images which the developer could clearly reproduced. Therefore, the greater the values of the resolution in Table 1, the better the resolution of the images.

The results are shown in Table 1.

TABLE 1

| | | Image density | | Background fouling | | Carrier adhesion | Resolution (lines/mm) | | Spent toner |
|---|---|---|---|---|---|---|---|---|---|
| | P* | Before R.T. | After R.T. | Before R.T. | After R.T. | After R.T. | Before R.T. | After R.T. | After R.T. |
| Ex. 1 | No | 1.41 | 1.32 | ○ | Δ | ○ | 5.6 | 4.5 | ○ |
| Ex. 2 | Yes | 1.42 | 1.33 | — | — | — | 5.6 | 4.5 | — |
| Ex. 3 | Yes | 1.39 | 1.39 | — | — | — | 5.6 | 4.5 | — |
| Ex. 4 | Yes | 1.42 | 1.40 | — | — | — | 6.3 | 6.3 | — |
| Comp Ex. 1 | No | 1.38 | 1.20 | ○ | X | ○ | 5.6 | 5.6 | X |
| Comp. Ex.2 | No | 1.35 | 1.09 | ○ | X | ○ | 5.6 | 5.0 | Δ |

P*: Projections
R.T.: "R.T." means the "running test" of 300,000 sheets.

As can be understood from Table 1, the developers of Examples 1 to 4 can produce images which have high image density and do not have background fouling, a carrier adhesion problem and a spent-toner problem, even after the 300,000 image running test is performed in an image forming apparatus having a toner recycle system. Among the developers of Examples 1 to 4, the developer of Example 4 is excellent.

On the contrary, the comparative developer of Comparative Example 1 produces images having background fouling because the friction charge of the developer seriously decreases and the carrier has no projections on the surface thereof. The comparative developer of Comparative Example 2 produces images having low image density because the friction charge of the developer seriously increases.

This document claims priority and contains subject matter related to Japanese Patent Application No. 11-262036, filed on Sep. 16, 1999, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A carrier for electrophotographic developer, comprising a magnetic core material having a surface coated with a resin, wherein the carrier satisfies the following relationship:

$1.0 \leqq C2/C1 \leqq 1.3$ wherein C1 represents a charge quantity of a developer (1) comprising the carrier and a first toner after the developer (1) is subjected to a frictional charge treatment once, wherein concentration of the first toner in the developer (1) is 3% by weight; and C2 represents a charge quantity of a developer (2) comprising the carrier, which has been separated from the developer (1) subjected to the frictional charge treatment, and a second toner, said developer (2) being subjected to a frictional charge treatment once, wherein concentration of the second toner in the developer (2) is 3% by weight, wherein said first toner and second toner can be the same or different.

2. The carrier according to claim 1, wherein the carrier further satisfies the following relationship:

$1.0 \leqq C3/C2 \leqq 1.3$ wherein C2 is defined above; and C3 represents a charge quantity of a developer (3) comprising the carrier, which has been separated from the developer (2) subjected to the frictional charge treatment, and a third toner, said developer (3) being subjected to the frictional charge treatment once, wherein concentration of the third toner in the developer (3) is 3% by weight, wherein said third toner can be the same as or different from either or both of the first and second toners.

3. The carrier according to claim 1, wherein the carrier has one or more micro projections on at least a portion of a surface thereof.

4. The carrier according to claim 3, wherein the one or more micro projections have an average minor diameter of from about 100 nm to about 200 nm.

5. The carrier according to claim 1, wherein the resin comprises a silicone resin.

6. The carrier according to claim 1, wherein the carrier has a dynamic current of from 0.1 $\mu$A to 0.5 $\mu$A.

7. The carrier according to claim 1, wherein said first and second toners are the same.

8. The carrier according to claim 2, wherein said first, second and third toners are the same.

9. A developer comprising a carrier and a toner, wherein the carrier comprises a magnetic core material whose surface is coated with a resin, wherein the carrier satisfies the following relationship:

$1.0 \leqq C2/C1 \leqq 1.3$ wherein C1 represents a charge quantity of the developer, wherein concentration of the toner in the developer (1) is 3% by weight; and C2 represents a charge quantity of a developer (2) comprising the carrier, which has been separated from the developer, and a second toner, said developer (2) being subjected to a frictional charge treatment once, wherein concentration of the second toner in the developer (2) is 3% by weight, wherein said toner and said second toner can be the same or different.

10. The developer according to claim 9, wherein the carrier further satisfies the following relationship:

$1.0 \leqq C3/C2 \leqq 1.3$ wherein C2 is defined above; and C3 represents a charge quantity of a developer (3) comprising the carrier, which has been separated from the developer (2) subjected to the frictional charge treatment, and a third toner, said developer (3) being subjected to the frictional charge treatment once, wherein concentration of the third toner in the developer (3) is 3% by weight, wherein said third toner can be the same as or different from either or both of said toner and said second toner.

11. The developer according to claim 9, wherein the carrier has one or more micro projections on at least a portion of a surface thereof.

12. The developer according to claim 11, wherein the one or more micro projections have an average minor diameter of about 100 nm to about 200 nm.

13. The developer according to claim 9, wherein the resin comprises a silicone resin.

14. The developer according to claim 9, wherein the carrier has a dynamic current of from 0.1 $\mu$A to 0.5 $\mu$A.

15. The carrier according to claim 9, wherein said toner and said second toner are the same.

16. The carrier according to claim 10, wherein said toner, said second toner and said third toner are the same.

17. A method for manufacturing a carrier for a developer, comprising the steps of:

providing a resin-coated carrier by coating a surface of a magnetic core material with a coating liquid comprising a resin, wherein the coating liquid has a resin content not less than 10.0% by weight; and crosslinking the resin while the resin-coated carrier is fluidized, wherein the carrier obtained satisfies the following relationship:

$1.0 \leqq C2/C1 \leqq 1.3$ wherein C1 represents a charge quantity of a developer (1) comprising the carrier and a first toner after the developer (1) is subjected to a frictional charge treatment once, wherein concentration of the first toner in the developer (1) is 3% by weight; and C2 represents a charge quantity of a developer (2) comprising the carrier, which has been separated from the developer (1) subjected to the frictional charge treatment, and a second toner, said developer (2) being subjected to a frictional charge treatment once, wherein concentration of the toner in the developer (2) is 3% by weight, wherein said first toner and said second toner can be the same or different.

18. The method according to claim 17, wherein the carrier further satisfies the following relationship:

$1.0 \leqq C3/C2 \leqq 1.3$ wherein C2 is defined above; and C3 represents a charge quantity of a developer (3) comprising the carrier, which has been separated from the developer (2) subjected to the frictional charge treatment, and a third toner, said developer (3) being subjected to the frictional charge treatment once, wherein concentration of the third toner in the developer (3) is 3% by weight, wherein said third toner can be the same as or different from either or both of said first and second toners.

19. The method according to claim 17, wherein the carrier obtained has one or more micro projections on at least a portion of a surface thereof.

20. The method according to claim 19, wherein the one or more micro projections have an average minor diameter of from about 100 nm to about 200 nm.

21. The method according to claim 17, wherein the resin comprises a silicone resin.

22. The method according to claim 17, wherein the carrier obtained has a dynamic current of from 0.1 $\mu$A to 0.5 $\mu$A.

23. The method according to claim 17, wherein said first and second toners are the same.

24. The method according to claim 18, wherein said first, second and third toners are the same.

25. A developer container having an opening and containing the developer according to claim 9.

26. An image forming apparatus comprising:

an image bearing member configured to bear an electrostatic latent image thereon;

a developer comprising a carrier and a toner;

a developing device configured to develop the electrostatic latent image with the developer to form a toner image on the image bearing member;

a transfer device configured to transfer the toner image onto a receiving material; and a fixing device configured to fix the toner image on the receiving material upon application of at least one of heat or pressure thereto, wherein the developer is the developer according to claim 9.

* * * * *

UNITED STATES PATENT AND TRADEMARK OFFICE

CERTIFICATE OF CORRECTION

PATENT NO. : 6,319,646 B1
DATED : November 20, 2001
INVENTOR(S) : Suganuma

It is certified that error appears in the above-identified patent and that said Letters Patent is hereby corrected as shown below:

Title page, Item [54], and Column 1, line 3,
Title should be: -- [54] CARRIER FOR ELECTROPHOTOGRAPHIC DEVELOPER, METHOD FOR MANUFACTURING THE CARRIER, DEVELOPER INCLUDING THE CARRIER, CONTAINER INCLUDING THE DEVELOPER, AND IMAGE FORMING APPARATUS USING THE DEVELOPER WHEREIN THE CARRIER SATISFIES THE RELATIONSHIP $1.0 \leq C2/C1 \leq 1.3$ --

Signed and Sealed this

Twenty-third Day of April, 2002

*Attest:*

*Attesting Officer*

JAMES E. ROGAN
*Director of the United States Patent and Trademark Office*